United States Patent [19]

Kuntzmann et al.

[11] Patent Number: 4,684,908

[45] Date of Patent: Aug. 4, 1987

[54] CIRCULAR WINDOW FOR ULTRA-HIGH FREQUENCY WAVEGUIDE

[75] Inventors: Jean C. Kuntzmann, Boulogne; Jacques Tikes, Orsay, both of France

[73] Assignee: Thomson-CSF, Paris, France

[21] Appl. No.: 689,985

[22] Filed: Jan. 9, 1985

[30] Foreign Application Priority Data

Jan. 17, 1984 [FR] France ..... 84 00664

[51] Int. Cl.[4] ..... H01P 1/08

[52] U.S. Cl. ..... 333/252; 333/33

[58] Field of Search ..... 333/252

[56] References Cited

U.S. PATENT DOCUMENTS

| | | | |
|---|---|---|---|
| 3,183,459 | 5/1965 | Caputo et al. | 333/252 |
| 3,436,694 | 4/1969 | Walker | 333/252 |
| 3,775,709 | 11/1973 | Firmain et al. | 333/252 |
| 3,860,891 | 1/1975 | Hiramatsu | 333/252 X |
| 4,358,744 | 11/1982 | Tikes | 333/252 X |

FOREIGN PATENT DOCUMENTS

| | | |
|---|---|---|
| 0031275 | 7/1981 | European Pat. Off. . |
| 1435031 | 2/1965 | France . |
| 2023370 | 8/1970 | France . |
| 2132180 | 11/1972 | France . |
| 601269 | 5/1948 | United Kingdom . |

*Primary Examiner*—Paul Gensler

*Attorney, Agent, or Firm*—Roland Plottel

[57] ABSTRACT

The present invention relates to a circular window for an ultra-high frequency waveguide. This window is constituted by a circular plate or wafer made from a dielectric material mounted in a waveguide section, connected on either side of a waveguide operating in a frequency band centered around the central frequency. The diameter of the circular plate is chosen so as to reject the ghost modes outside the frequency band. The length of the circular guide section is chosen so that the reactance of the assembly constituted by the plate and the circular guide is cancelled out for the central frequency. It also comprises a half-wave impedance transformer, whose height is chosen so as to bring about the matching in the operating frequency band. The window associated with rectangular waveguides is more particularly used with tubes for telecommunications.

11 Claims, 12 Drawing Figures

FIG_1-a
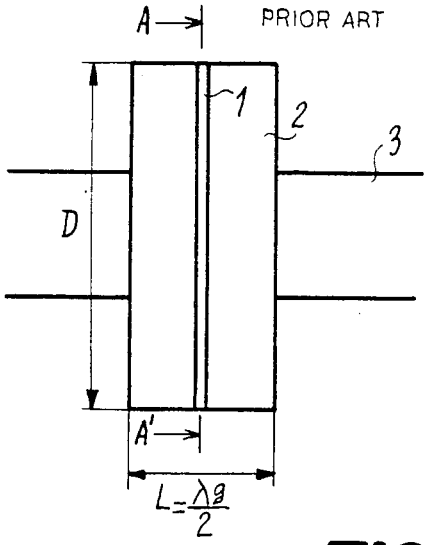
FIG_1-b
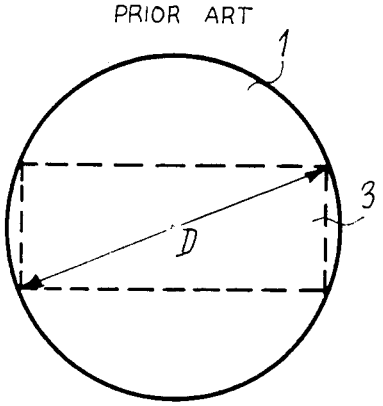
FIG_2
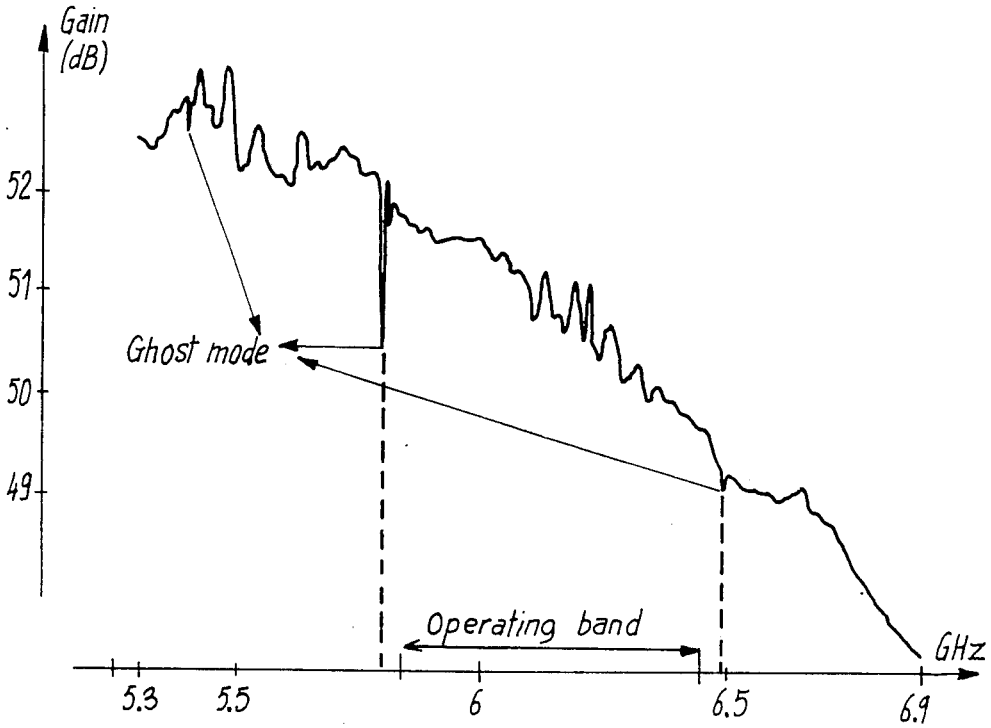

FIG_3-a
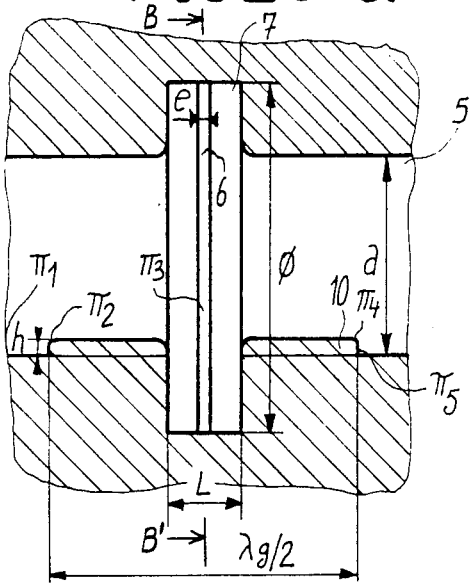
FIG_3-b
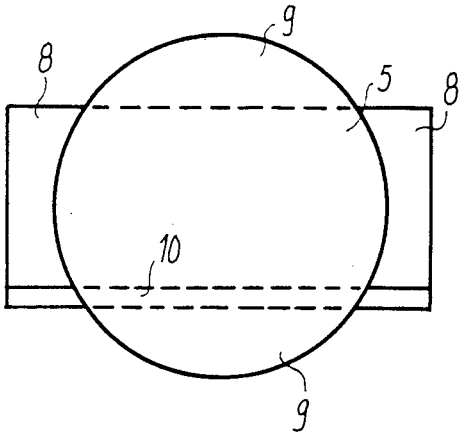
FIG_3-c
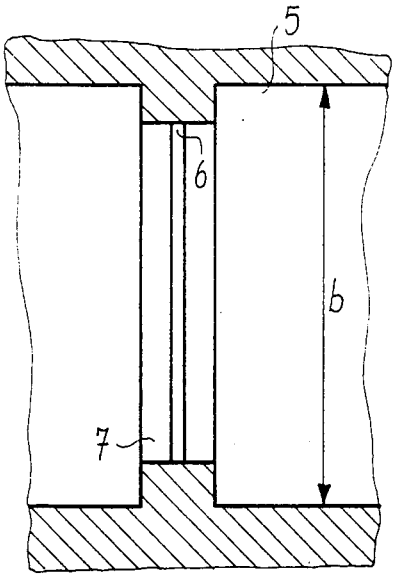
FIG_4
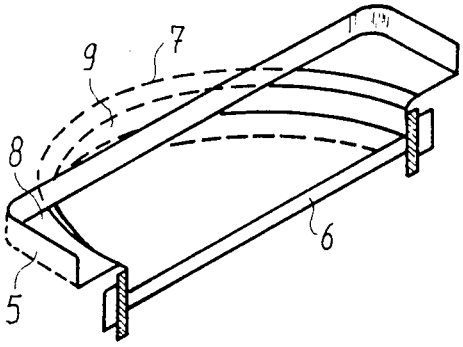

CIRCULAR WINDOW FOR ULTRA-HIGH FREQUENCY WAVEGUIDE

BACKGROUND OF THE INVENTION

1. Field of the Invention

The present invention relates to a window for an ultra-high frequency waveguide and more particularly a circular window.

Thus, ultra-high frequency devices operating at a pressure differing from atmospheric pressure generally require a tight window serving to insulate same from the external pressure and permit the propagation of ultra-high frequency waves without producing either reflection or internal resonance, which is e.g. the case with microwave tubes and accelerators operating at substantially zero pressures, as well as circulators, insulators, coaxial lines and waveguides in which a gas can be trapped in order to increase their power characteristics, whereby the pressure of the gas can reach 3 $kg/cm^2$ or higher.

Therefore the ultra-high frequency windows used in these devices must have an adequate strength to resist a pressure, which can exceed 3 $kg/cm^2$ in the least favourable case, i.e. when they are associated with a device operating at high pressure. Moreover, the ultra-high frequency windows must also be able to withstand temperature variations which can reach 800° C. during the final brazing in the component.

It is desirable for the ultra-high frequency to be usable in a wide pass band substantially corresponding to the pass band of ultra-high frequency devices in which they are fitted and in said band they must not have ghost modes. It is also preferable that within the said frequency band, the standing wave ratio is low and consequently the reflections are limited.

2. Description of the prior art

Among the prior art windows used in the aforementioned devices, in particular the pill-box window is known. As shown in FIGS. 1*a* and 1*b*, the pill-box window is constituted by a thin dielectric plate or wafer 1, which is brazed into a section of a circular waveguide 2 connected on either side to a rectangular waveguide 3. In this case, the propagation modes are respectively the mode TE 01 in the rectangular guides 3 and mode TE 11 in circular guide 2. As is more particularly shown in FIG. 1*b*, the diameter of the circular guide is substantially equal to the diagonal of the rectangular guide 3, so as not to modify the electric wavelength $\lambda g$ between the rectangular guide and the circular guide. Moreover, the length L of the circular guide is electrically equal to half the guided wavelength $\lambda g$. The pill-box window thus behaves in the same way as a half-wave impedance transformer, so that the matching is perfect at the central frequency, but progressively deteriorates on either side. As shown in FIG. 2, this type of window has numerous ghost modes, which reduce its operating band to a useful band of approximately 10% with respect to the central frequency. Thus, it is possible to see on the curve of FIG. 2 ghost modes for the frequencies 5.4, 5.8 and 6.5 GHz, which gives a useful pass band of 575 MHz, between e.g. $F_1=5.850$ GHz and $F_2=6.425$ GHz.

Furthermore, all the dimensions of the pill-box window are chosen so as to cause no problem with respect to ultra-high frequency operation. The worker in the art can optionally modify the dimensions of these windows in order to shift the frequency band while remaining matched, but without significantly modifying said frequency band.

Thus, the pill-box window suffers from numerous disadvantages with respect to the width of the useful frequency band, particularly in the case of microwave tubes with a high continuous wave power used for telecommunications, for which the natural amplification band largely exceeds the useful band, so that there is a risk of destruction in the case of an accidental use outside the normal band of use.

To obviate this disadvantage the applicant proposed in European Patent Application No. 31275 a rectangular window which could be used in a wide frequency band without a ghost mode and in which the standing wave ratio is low. However, numerous problems were encountered when fitting such windows in the waveguides.

SUMMARY OF THE INVENTION

The present invention, which has resulted from research lasting many years, consequently aims at obviating these disadvantages.

The present invention therefore relates to a circular window for an ultra-high frequency waveguide, constituted by a circular dielectric material plate mounted in a circular waveguide section connected on either side to a waveguide operating in a frequency band centered round a central frequency, wherein the diameter of the circular guide section is chosen so as to reject ghost modes outside the operating frequency band wherein the length of the circular guide section is chosen so that the reactance of the plate-circular guide assembly is cancelled out at the central frequency, and wherein it comprises a half-wave impedance transformer, the relevant wavelength being the electrical wavelength corresponding to the central frequency, whose height is chosen so as to bring about matching in the operating frequency band.

When using the windows according to the present invention, a usable band width is obtained, which corresponds to more than 40% relative to the central frequency, with a standing wave ratio below 1.15 and without ghost modes.

BRIEF DESCRIPTION OF THE DRAWINGS

The invention is described in greater detail hereinafter relative to non-limitative embodiments and the attached drawings, wherein FIGS. 1*a* and 1*b* already described, show respectively a longitudinal sectional view and a sectional view through AA' of FIG. 1*a* of a prior art pill-box window.

FIG. 2 already described, show a graph giving the gain as a function of the frequency for a telecommunications travelling wave tube using a prior art pill-box window.

FIGS. 3*a*, 3*b*, and 3*c*, respectively, show a longitudinal sectional view along the small side of a rectangular waveguide of an embodiment of a circular window according to the present invention used in a rectangular guide, A section through BB' of FIG. 3*a* and a longitudinal sectional view along the large side of the waveguide.

FIG. 4 shows a prespective view of the circular window of FIGS. 3*a* to 3*c*.

In the different drawings, the same references designate the same elements.

DESCRIPTION OF THE PREFERRED EMBODIMENTS

Figure 5:
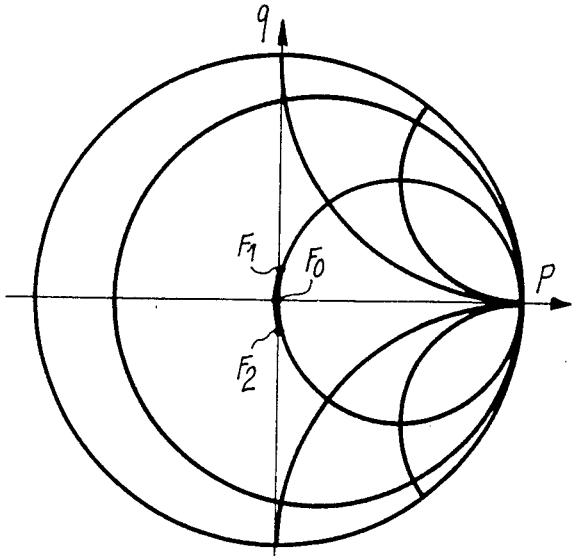
FIGS. 5 to 7 are Smith diagrams illustrating the operation of a circular window according to the invention.

FIGS. 3*a* to 3*c*, as well as FIG. 4 show different views of an embodiment of a circular window according to the present invention used in a rectangular waveguide 5.

The circular window according to the invention comprises a thin, dielectric material circular plate or wafer 6, preferably made from a ceramic material such as alumina or the like, fitted into the circular waveguide section 7, brazed on either side of rectangular waveguide 5. The thickness e of the dielectric plate has been chosen in such a way as to obtain the desired rigidity and sealing. Moreover, the diameter $\phi$ of the dielectric plate, which is also the circular guide diameter, is chosen so as to reject the ghost modes well beyond the frequency band $F_1$, $F_2$ to be transmitted by the rectangular guide in which the window is inserted. As is clearly shown in FIGS. 3*a* and 3*c*, the circular guide diameter $\phi$ is between the dimension a of the small side of the rectangular guide and the dimension b of its large side. This produces parts 8 and 9 seen in FIG. 3*b* which act as inductances in the operating band. Parts 8 and 9 associated with the dielectric plate 6 give a pure reactance. Therefore the length L of waveguide section 7 is chosen so that the reactance of the assembly constituted by dielectric plate 6 and circular guide parts 8 and 9 is cancelled out for the central frequency $F_0$. The window also has a half-wave impedance transformer 10 constituted by two elements of the same length placed on either side of the circular guide in the rectangular guide and covering e.g. one of the large sides of the rectangular guide 5. It can also be distributed over the two large sides. As shown in FIG. 3*a*, it can be produced by an asymmetrical reduction of the guide height. As seen in FIG. 3*a*, the length will be short relative to the distance $\lambda g/2$ since the latter includes the length of the element 10. According to another embodiment, the transformer can be realized with the aid of a metal plate joined to one of the large sides of the guide.

As will be explained in greater detail hereinafter, the transformer height h is chosen so as to bring about the matching in the operating frequency band $F_1F_2$.

An explanation will now be given relative to FIGS. 5 to 7 of the operation of a circular window, like that shown in FIGS. 3*a*, 3*b*, 3*c* and FIG. 4.

FIG. 5 shows on the Smith diagram the variations in the frequency band $F_1$, $F_2$ of the impedance of the assembly constituted by the dielectric plate 6, as well as the inductance parts 8 and parts 9 of the circular guide section 7.

The thickness e of the dielectric plate the diameter $\phi$ and the length of the circular guide section have been chosen so that the impedance of the above assembly is a pure reactance which progressively passes through the inductance, zero and capacitive values in the sense of the frequencies rising from $F_1$ to $F_2$ and is cancelled out for $F_0$.

The variations of the impedance of the assembly constituted by plate 6, inductance parts 8 and circular guide parts 9 are consequently represented on the Smith diagram by a straight line segment carried by the axis of the impedance q, which is located in the half-plane of the inductance impedances for $F_1$, passing through the centre of the diagram for $F_0$ and is then located in the half-plane of the capacitive impedances for $F_2$. Thus, there is a certain variation in the reactance in the operating band of the guide, which must be compensated in order to obtain a correct ultra-high frequency operation.

Figure 6:
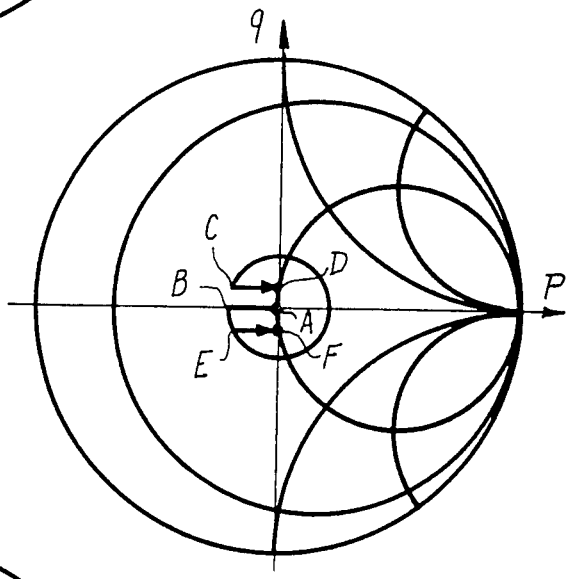

On the Smith diagram in FIG. 6, are shown the impedance variations at different points on a half-wave impedance transformer fitted in a rectangular waveguide and connected to a matched termination, said variations being given for frequencies $F_1$, $F_0$ and $F_2$. The symbols used are explained as follows:

$\pi 1$, a plane of the guide located on the side of the generating line upstream of the transformer;

$\pi 2$, the transformer input plane;

$\pi 3$, the transformer median plane;

$\pi 4$, the transformer output plane;

$\pi 5$, a plane of the guide located on the side of the matched termination against the transformer.

These different planes are shown in FIG. 3*a*.

Upstream of the impedance transformer at plane $\pi 1$, there is a matching no matter what the impedance, the impedance being represented by point A in the centre of the Smith diagram.

Arriving in plane $\pi 2$ means that no matter what the frequency, a purely resistive impedance reduction occurs and the impedance is represented by point B to the left of point A on the axis p of the resistances of the Smith diagram.

The displacement from plane $\pi 2$ to plane $\pi 4$ on length $\lambda g/2$ leads to a rotation on a circle of radius AB centred on point A in the trigonometric sense. The rotation angle is dependent on the operating frequency, so that it is $2\pi$ for $F_0$ of $2\pi\ F_1/F_2$ for $F_1$, and $2\pi(F_2/F_0)$ for $F_2$.

At plane $\pi 4$, the impedance is represented by point C located on the circle above point B for $F_1$. The impedance is represented by point B for $F_0$ and by point E located on the circle below point B for $F_2$.

At plane $\pi 5$, the transformer is cleared and there is a purely resistive impedance increase, which compensates the reduction which occurred in plane $\pi 2$.

Thus, the impedance of plane $\pi 5$ is represented at frequencies $F_1$, $F_0$ and $F_2$ by points D, A and F, which are substantially aligned on axis q of the impedances. Points D and F are located on either side of A. The impedance in the median plane $\pi 3$ at $\lambda g/4$ from plane $\pi 5$ is deduced from the impedance at plane $\pi 5$ by a 180° rotation of the straight line segment D A F.

Figure 7:
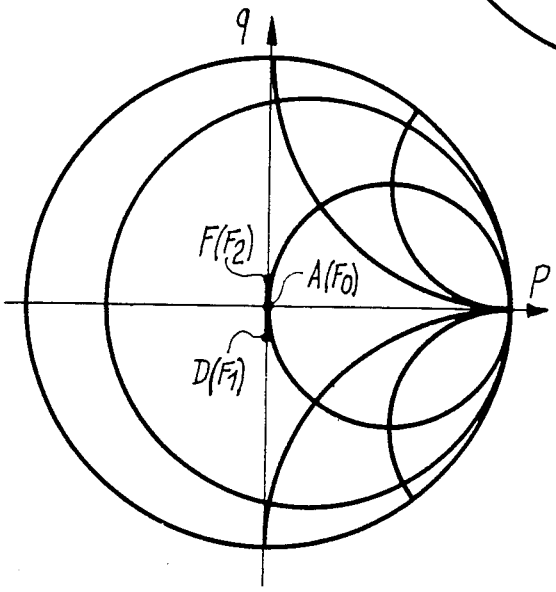

Thus, as shown in FIG. 7, in plane $\pi 3$ the impedance of the half-wave transformer is consequently an impedance which successively assumes purely capacitive, zero and purely inductance values in the sense of frequencies rising from $F_1$ to $F_2$, namely from D to F.

On comparing FIGS. 5 and 7, it can be seen that the variations in the frequency band $F_1$, $F_2$ of the transformer impedance and the impedance constituted by the dielectric plate 6, the inductance part 8 and the circular guide parts 9 are purely reactive and take place in opposite directions as a function of the frequency.

Figure 8:
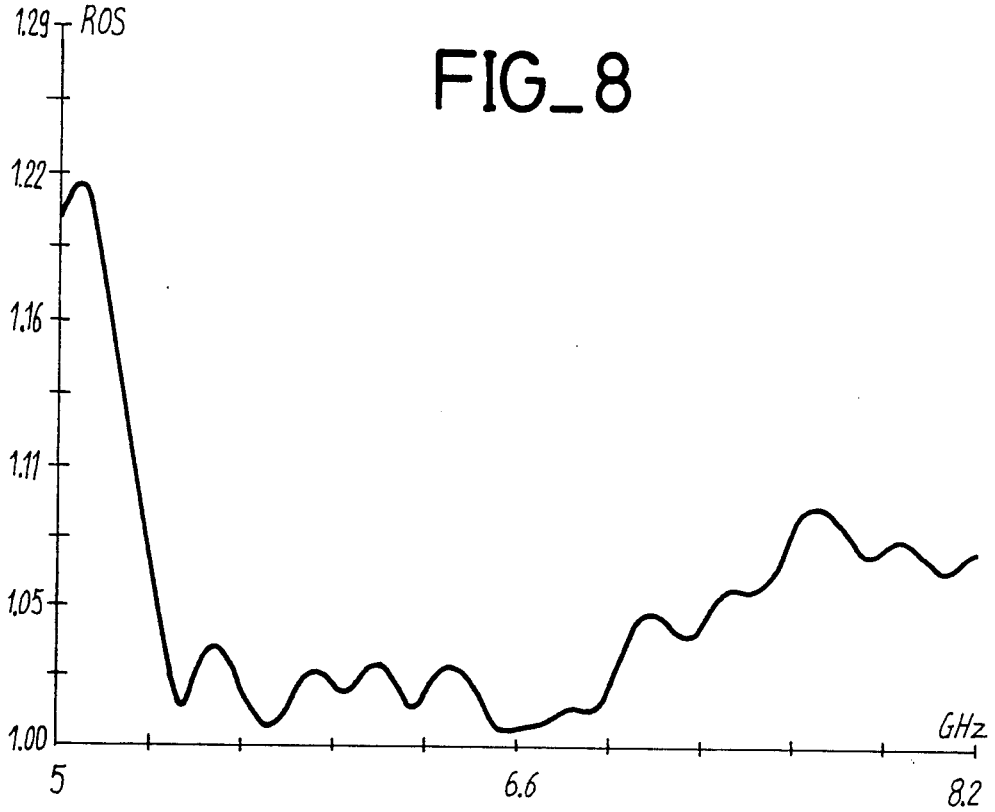
FIG. 8 is a graph giving the standing wave ratio as a function of the frequency in a circular window according to the invention.

Consequently, according to the invention and as mentioned hereinbefore, the dimensions of the dielectric plate and the circular guide, as well as the transformer height h are determined so that the transformer impedance and the impedance of the assembly constituted by the dielectric plate and the circular guide elements are compensated in the frequency band $F_1$, $F_2$, so as to be matched with standing wave ratio substantially equal to 1 and without having ghost modes in the frequency band $F_1$, $F_2$, as can be seen in FIG. 8 which is a diagram giving the standing wave ratio as a function of the frequency in a circular window according to the present invention.

Moreover, it is pointed out that the circular guide section 7 is at the cut-off frequency. However, as the circular guide section length is very small, compared with the electric wavelength λg, there is no wave transmission problem. A circular window according to the invention has been tested on a rectangular waveguide of internal dimensions 15.80×34.85 mm. The window dimensions are as follows:

| | |
|---|---|
| dielectric material | thickness 0.8 mm, |
| (alumina) plate | diameter 28 mm |
| cylindrical guide | length 6 mm |
| transformer | length 26 mm |
| | height 1.3 mm |

In this case, the standing wave ratio is 1.15 in a frequency band of 5.15 to 8.15 GHz without ghost mode. The use band width compared with the central frequency is consequently raised to 45%. The first ghost mode occurs at 8.18 GHz.

A description will now be given with reference to FIG. 9 of a practical embodiment of a circular window according to the present invention. Firstly the ceramic dielectric plate 6 is brazed to a circular sheath 11 made from a metallic material, such as copper or which is metallized. For this purpose and in per se known manner, the dielectric plate edge is firstly metallized with a molybdenum-based powder. The sheath 11 also forms the wall of the circular guide 7. Sheath 11 is inserted in a cylindrical frame 12 with a U-shaped cross-section. Two metal connection pieces 13 are provided on either side of frame 12 to bring about the connection between the circular guide and the rectangular waveguide 5 according to the invention. The internal side walls of the connecting pieces 13 form the inductance part 8, at the large sides of the rectangular waveguide. These connecting pieces 13 are respectively brazed to the frame 12 and to ends of the two rectangular guide sections 5.

Moreover, in the embodiment shown, the half-wave transformer 10 is constituted by two metal plates, which are brazed on to one of the large sides of the rectangular wave guide 5.

Figure 9:
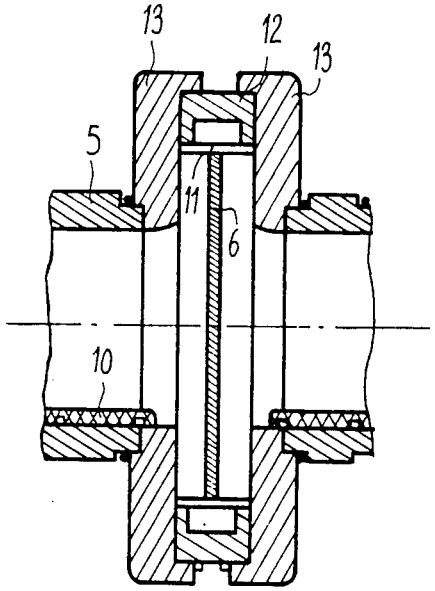
FIG. 9 is a diagrammatic sectional view along the small side of the guide illustrating an embodiment of a circular window according to the invention.

The assembly shown in FIG. 9 with the dimensions referred to hereinbefore permits a very wide use band with a high continuous wave power, as is shown in FIG. 8.

In the present invention, the circular window is used in a rectangular waveguide. However, the windows according to the invention can also be used in waveguides having random cross-sections, such as e.g. elliptical guides. The waveguides of the present invention are more particularly used in satellite telecommunications equipment, e.g. in the bands for "Intelsat".

What is claimed is:

1. A window for an ultra high frequency waveguide for insertion between two waveguide sections of a main waveguide which is designed for transmitting wave energy of an operating band of wavelengths centered about a wavelength λg each waveguide section having a long side dimension and a short side dimension comprising an assembly including a circular plate of dielectric material and a section of circular waveguide of the same diameter as the plate for transversely supporting the plate, the diameter of the circular waveguide being intermediate between the long and short side dimensions of the two waveguide sections, for forming inductances, and the length of the section of circular waveguide being shorter than λg/2 and such that said inductances compensate for the intrinsic capacitance of the circular plate, whereby the reactance of the assembly is essentially cancelled out at the wavelength λg and half-wave impedance transformer means included within the two waveguide sections, for cooperating with the assembly for matching in the operating band of wavelengths.

2. A window in accordance with claim 1 included between two waveguide sections wherein said two waveguide sections are each of the same rectangular cross section.

3. A window in accordance with claim 1 included between two waveguide sections wherein said two waveguide sections are each of the same elliptical cross section.

4. A window in accordance with claim 1 wherein the half-wave transformer means is produced by non-symmetrically reducing the height of the guide relative to the median plane of the waveguide.

5. The window in accordance with claim 1 in which the main waveguide is a rectangular waveguide.

6. A window in accordance with claim 1 in which the main waveguide is an elliptical wave guide.

7. A window in accordance with claim 1 in which the section of circular waveguide is free of any conductive reflecting means.

8. A window in accordance with claim 1 in which the circular waveguide is of uniform diameter along its entire length between the two sections of main waveguide.

9. A window according to claim 1, wherein the half-wave transformer is constituted by two identical half-transformers located on either side of the circular guide section in the waveguide and having a length λg/2 between their two most remote ends.

10. A window according to claim 9, wherein the two half-transformers means are produced by symmetrically reducing the height of the guide relative to the median plane of the waveguide.

11. A window according to claim 9, wherein the two half-transformers are produced by connecting a metal plate to at least one of the large sides of the guide.

* * * * *